United States Patent [19]

Foulard et al.

[11] Patent Number: 4,805,688

[45] Date of Patent: Feb. 21, 1989

[54] PROCESS FOR PROTECTING AGAINST OXIDATION AND/OR NITRIDATION OF A LIQUID METAL STREAM AND DEVICE FOR CARRYING OUT THE PROCESS

[76] Inventors: Jean Foulard, 15, rue La Sabliere, 94480 Ablon; Jacques Nicolas, 8, rue Alasseur, 75015 Paris; Jean-François Mignot, 275, rue de l'Arclusaz, 38530 Pontcharra, all of France

[21] Appl. No.: 896,124

[22] Filed: Aug. 12, 1986

[30] Foreign Application Priority Data

Aug. 14, 1985 [FR] France ..... 85 12378

[51] Int. Cl.[4] ..... B22D 11/04; B22D 11/10

[52] U.S. Cl. ..... 164/475; 164/415; 222/603; 266/207

[58] Field of Search ..... 164/475, 415, 437, 337; 222/603; 266/207, 217

[56] References Cited

U.S. PATENT DOCUMENTS

| | | | |
|---|---|---|---|
| 3,439,735 | 4/1969 | Holmes | 164/415 X |
| 3,616,843 | 11/1971 | Newhall et al. | 164/415 X |
| 4,270,595 | 6/1981 | Coward | 164/415 |
| 4,565,239 | 1/1986 | Meier | 164/415 X |

FOREIGN PATENT DOCUMENTS

| | | | |
|---|---|---|---|
| 0015251 | 9/1980 | European Pat. Off. | 222/603 |
| 2517834 | 11/1976 | Fed. Rep. of Germany . | |
| 2738587 | 3/1978 | Fed. Rep. of Germany . | |
| 2331402 | 6/1977 | France . | |
| 57-48307 | 10/1982 | Japan | 164/437 |

*Primary Examiner*—Nicholas P. Godici
*Assistant Examiner*—J. Reed Batten, Jr.
*Attorney, Agent, or Firm*—Lee C. Robinson, Jr.

[57] ABSTRACT

Process for protecting against oxidation and/or nitridation of a liquid metal stream flowing from the outlet orifice of a ladle or a distribution vessel, comprising surrounding the pouring stream with a tube substantially throughout the height of the stream and injecting a protective gas at least around the pouring stream so as to minimize the contact of the molten metal with the ambient air and avoid the dilution of the protective gas and the aspiration of ambient air. A device for carrying out the process includes two complementary semi-shells for surrounding the pouring stream and a hinge articulating the semi-shells for opening and closing the latter.

19 Claims, 6 Drawing Sheets

PROCESS FOR PROTECTING AGAINST OXIDATION AND/OR NITRIDATION OF A LIQUID METAL STREAM AND DEVICE FOR CARRYING OUT THE PROCESS

The present invention relates to a process for protecting against oxidation and/or nitridation of a liquid metal stream flowing from the outlet orifice of a ladle or a distribution vessel into a oscillating ingot mould, in which the pouring stream is surrounded, in at least a part of its height, with a tube into which there is injected a gas for protecting the liquid metal so as to limit the contact of the latter with the ambient air between the outlet orifice and the oscillating ingot mould.

The invention also relates to a device for carrying out such a process and to the use of this device.

The invention is more particularly applicable to continuous casting and in particular to small-size continuous casting.

Continuous casting installations usually comprise one or more vertical streams which fall vertically into a oscillating ingot mould. During its free fall from the distribution vessel (or the ladle) into the ingot mould, the liquid metal is liable to be oxidized and/or nitrided. Consequently, it has already been envisaged to protect the metal from such reactions by surrounding it, in the major part of its free fall, by a sleeve or ring of neutral gas such as argon, nitrogen, carbon dioxide, etc. However, presently-known devices have a number of drawbacks, in particular as concerns difficulties or fluidtightness, placement, performance over a period of time, and consumption of the neutral protective gas.

In particular, in continuous casting for forming billets of small sections, there is usually employed a tube which is placed around the pouring stream. However, these tubes must be frequently changed, since the operation of the distribution vessel damages them. Further, their fixing after the beginning of the pouring produces splashing. Lastly, it is not easy to remove them in the event of problems.

However, whatever presently-known device is used, there are problems of dilution of the protective gas, on one hand, and aspiration of air, on the other hand. The problem of dilution arises mainly during the use of devices such as those disclosed in U.S. Pat. Nos. 4,084,799 or 4,102,386. In U.S. Pat. No. 4,084,799, the cylindrycal protective tube is connected to the distribution vessel or the ladle in a substantially sealed manner. Bearing in mind the usual distance on the order of 40 cm between the distribution vessel and the mean position of the oscillating ingot mould, this device, which has a length substantially equal to one half this distance, is therefore located at about 20 cm from the oscillating ingot mould. Further, the inside diameter of the tube, in its lower part, appears to be slightly greater than the width of the oscillating ingot mould. Lastly, there is no indication in this patent concerning the manner of injecting the gas into the tube to avoid the dilution of this gas with the ambient air when said gas issues from the protective tube. It has been found in practice that, with such a geometry of the tube, it is usually impossible to attain the object of the invention, namely a concentration of oxygen around the pouring stream down to the bottom of the stream in the ingot mould, of lower than about 1%.

The problem of the aspiration of air arises mainly during the use of devices such as those disclosed in U.S. Pat. No. 3,439,735.

The devices of this type comprise a circular tube surrounding the pouring stream, which tube becomes larger in its lower part so as to come to bear on the table surrounding the oscillating ingot mould, the inside diameter of the lower part of the tube being, here again, larger than the width of the oscillating ingot mould. Although it is in this way possible to avoid entries of air from the base and therefore the phenomenon of the progressive dilution of the protective gas as it descends along the pouring stream, there is produced with such a system a large aspiration of the ambient air from the top. Indeed, the protective gas sent toward the bottom in the same direction as the pouring stream, cannot oppose the aspiration of the ambient air owing to the great differences of temperatures of the gas in the vicinity of the stream and of the ambient air. Thus turbulences occur in the vicinity of the pouring stream and the latter is consequently in direct contact with the ambient air in certain regions. In the absence of any indication as to the flow of the protective gas, it is not possible to attain the object of the invention.

The two phenomena of dilution of the protective gas and aspiration of air again occur when using the device disclosed in U.S. Pat. No. 3,908,734.

An object of the present invention is to overcome these drawbacks by providing an effective protecting process and a device which may be easily placed in position during the flow of the liquid metal and which give, for a low consumption of gas, excellent metallurgical results.

The protecting process according to the invention is characterized in that the protective tube is connected to the ladle or distribution vessel and has such length that the maximum distance D between its lower end and the oscillating ingot mould, when the latter is in its lower position, is less than 100 mm, and the protective gas is injected into the tube in such manner as to surround the pouring stream and to be discharged to the exterior through the lower end of said tube with a mean velocity of the gases discharged in the vicinity of the lower end of the tube of between about 0.7 m/s and 5/5 m/s so as to limit, on one hand, the dilution of the protective gas with the air at any point in the vicinity of the pouring stream and, on the other hand, the aspiration of the ambient air toward the pouring stream. The applicant believes, without however wishing to be tied by any theory, that such a process enables the protective gas to follow the pouring stream down to the surface of the liquid metal in the ingot mould and to subsequently rise so as to be discharged between the lower part of the protective tube and the upper part of the ingot mould, in this way urging the air toward the exterior.

Preferably, the distance $D_1$ is less than or equal to 80 mm.

According to a preferred embodiment, the tube has a circular section in a plane perpendicular to the pouring stream, the diameter $D_2$ of the tube in its lower part being preferably less than, or at the most equal to, the width of the oscillating ingot mould.

Also, preferably, a flange will be used in the vicinity of the lower part of the tube and will surround the tube substantially throughout its periphery, the diameter $D_2$ of the tube being so chosen that the diameter $D_3$ of the flange is preferably less than, or at the most equal to, the width of the oscillating ingot mould, this flange being preferably oriented to be parallel to the opening of the ingot mould.

According to another aspect of the invention, allowing a reduction of the flow rate of the protective gas, for the same concentrations of oxygen, the protective tube comprises a bottom which widened, the diameter $D_2$ of the tube in its lower part being so chosen that the diameter $D_4$ of the widened part of the bottom of said tube is less than the width of the oscillating ingot mould.

The device according to the invention comprises, below the bottom and around the outlet orifice, an inert condition producing shell, which is openable and formed by two semi-shells, being applicable against the bottom of the ladle and/or the distribution vessel and ensuring the injection of protective gas at low velocity and uniformly around the metal stream on a major part of its height; this is achieved in such manner that the fluidtightness of the plane of junction of the semi-shells guarantess a good seal throughout the length of the metal stream. It is preferably provided in its lower part with an appropriate aerodynamic device, such as a flange or a flare, which reduces the dilution of the protective gas with the ambient air.

The device according to the invention is characterized in that the means for surrounding the pouring stream comprise, on one hand, two complementary semi-shells, and, on the other hand, means for articulating the semi-shells so as to permit the opening and closing of the latter.

Preferably, it comprises means for effecting an aerodynamic deflection placed close to the lower part of the semi-shells. The aerodynamic deflection means preferably comprise a flange or a flare formed by two semi-flanges, each connected to a semi-shell, and/or a chanfered part located at the lower end of the inner wall of each semi-shell and extending in the direction of an outer wall. Preferably, the planes of junction of the two semi-shells partly overlap so as to improve the fluidtightness of the shell.

According to a modification, the device according to the invention comprises a concentric sleeve placed around the semi-shells and formed by two complementary semi-sleeves, each thereof being connected to its corresponding semi-shell, the space between the sleeve and the semi-shells being connected to means for injecting a protective gas.

According to another aspect of the invention, it comprises in its uppwer part at least one annular sealing element for providing a seal between the shell and the pouring distribution vessel under which it must be placed. When the device is adapted to be coupled to a pouring distribution vessel around the pouring orifice of the latter, it may cooperate with a circular collar connected to the distribution vessel and adapted to improve the gastightness of the coupling.

According to a first modification, the means for articulating the semi-shells are formed by a hinge.

In a second modification, the means for articulating the semi-shells are formed by an assembly of articulated arms whereby it is possible to move the semi-shells away from each other, said articulated arms being controlled by control means.

In an embodiment which is particularly well-adapted for the metallurgical industry, it comprises a movable arm which is connected thereto at one end and connected to means for placing said shell flat against the distribution vessel.

It will be understood that the gases used for protecting the pouring stream against oxidation and/or nitridation are those usually employed in such cases by one skilled in the art, such as nitrogen, argon, carbon dioxide, etc. used alone and/or in mixtures.

A better understanding of the invention will be had from the following description of embodiments given by way of non-limiting examples with reference to the accompanying drawings, in which:

FIG. 1 is a diagrammatic sectional view of an embodiment of the device according to the invention and of certain modifications.

The protecting device according to the invention comprises a shell 1 formed by two complementary semi-shells 1A, 1B and means for injecting protective gas, these means being mainly formed by a duct 8 of annular shape placed at the top of the shell 1, this duct 8 being provided with ports 9 allowing the passage of the gas issuing from the supply conduits 7A and 7B respectively connected to the two annular semi-ducts 8A and 8B constituting the duct 8 and respectively connected to the two semi-shells 1A and 1B. The device further comprises means for articulating the semi-shells (not shown in the FIG. ). The diameter, the position, and the number of the ports will be determined experimentally by one skilled in the art by simple routine experiments in accordance with the desired result and the rate of flow of inert gas.

Figure 1:
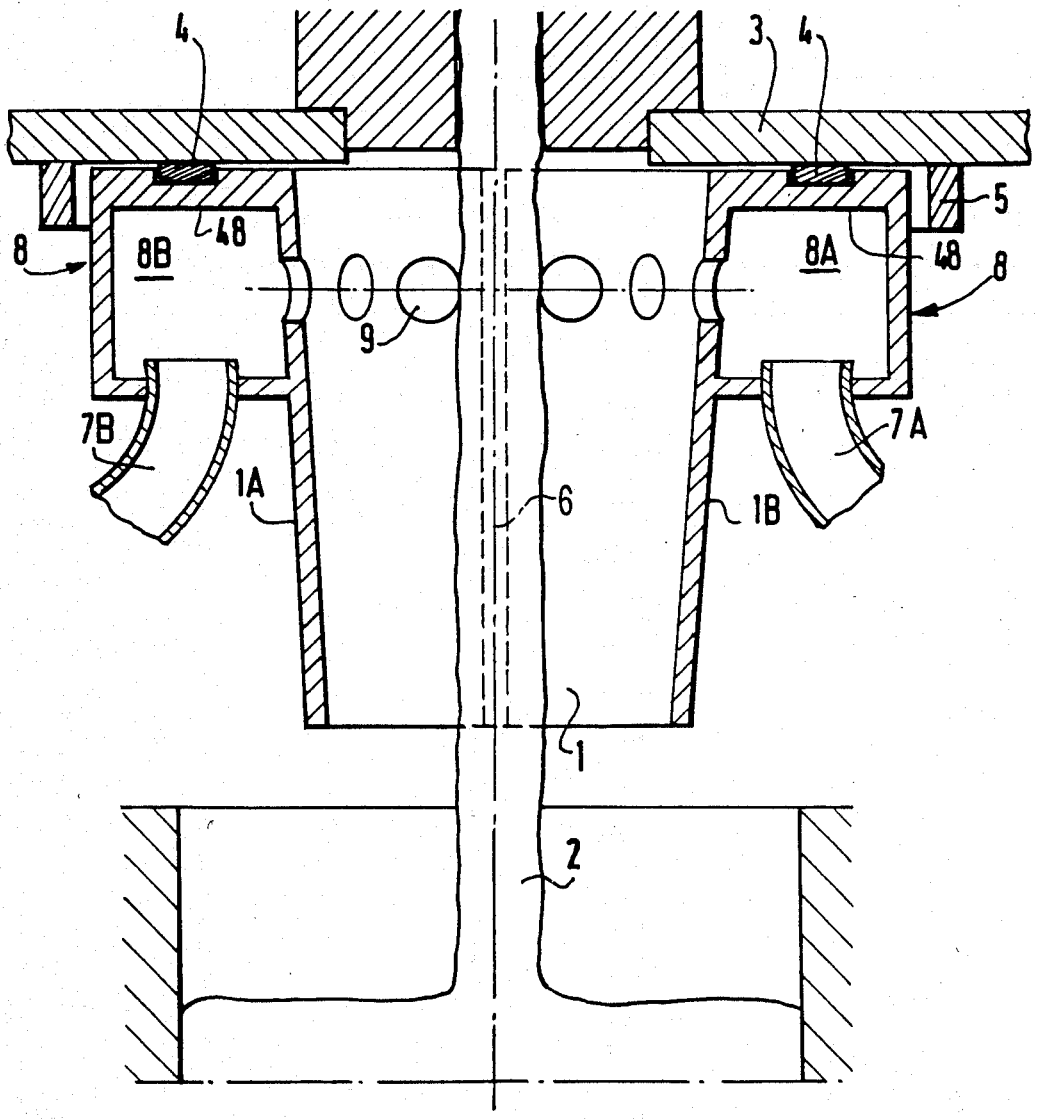
FIG. 1 is a diagrammatic vertical sectional view of a device for protecting a liquid metal stream against oxidation according to the invention.

The distribution vessel, only the bottom 3 of which is shown in FIG. 1, is provided with a collar 5 whose shape is complementary to the outer shape of the duct 8, i.e. circular in the presently-described embodiment. On its upper face, the annular duct 8 has a circular groove 48 in which there is disposed a sealing element 4 providing a seal between the distribution vessel and the device according to the invention.

The two semi-shells 1A and 1B partly overlap along the joint line 6 and provide a seal owing to a baffle structure. The inner wall 66 (FIG. 1C) of the semi-shell 1B is radially secured to the latter with a step 72 which thus forms a baffle 67, 68 and 69 for the gas which comes from inside the shell and would escape to the exterior. With such a pressure drop, the gas introduced in a streamlined flow in the shell through the ports 9, substantially cannot escape through the lateral joint 6.

Note that the lateral end 70 of the semi-shell is 1B comes to bear, apart from clearance, after closure, against the lateral end 71 of the wall 65.

Figure 1A:
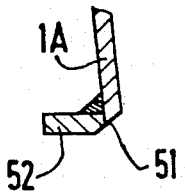
FIG. 1A is a fragmentary vertical sectional view of a modification of a portion of the device shown in FIG. 1.
Figure 1B:
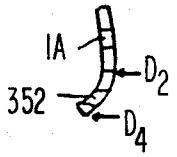
FIG. 1B is a fragmentary vertical sectional view of another modification of the portion of the device.
Figure 1C:
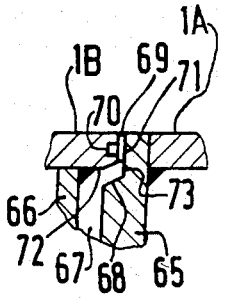
FIG. 1C is an enlarged fragmentary vertical sectional view of the joint between the two semi-shells for the device.

FIGS. 1A and 1B show two modifications of the aerodynamic means according to the invention placed at the lower end of the shell 1. The inner wall of the semi-shell 1A is chamfered at about 45°, while a flange 52 is fixed at the end to the outer wall of the shell 1. Alternatively, the semi-shell is widened at the bottom to form a flare 352 having a diameter $D_4$ greater than $D_2$. Preferably the flare has about a circular horizontal section.

Figure 1D:
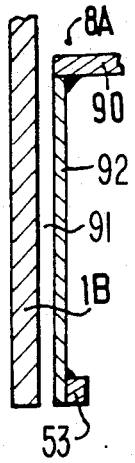
FIG. 1D is an enlarged fragmentary vertical sectional view of a portion of one of the semi-shells, together with a cooperating sheath.

The semi-shells, such as 1B, are surrounded, substantially from the base of the annula duct 8 to the lower end of the semi-shell, by a sheath 92 (FIG. 1D) disposed coaxially with the semishells so as to form a space 91 which communicates with the annular duct 8 supplying gas or constituting a distribution chamber of the gas (this supply of gas could be different if it was required to create a gaseous sheath of different nature).

In this modification, it is also possible to eliminate the wall 1B in the region of the wall 90. In this way a gas flow will be produced by the ports 9 while a second flow will be sent through the outlet slot 91 of the duct 8 and directed downwardly so as to surround the stream at this level. The rates of flow are respectively adjusted in accordance with the diameter of the ports and the width of the slot.

This sheath 92 preferably comprises an aerodynamic flange 53 at its base.

As the protecting device is designed in particular for the continuous casting in small-size ingot moulds, it is not possible in this case to introduce the lower end of the shell into the metal, bearing in mind the respective dimensions of the stream, the shell and the opening of the ingot mould. This is why there is a clearance between the lower part of the shell and the pouring opening, this clearance moreover permitting the shifting of the device in the course of pouring if found necessary.

In the normal position of operation, the inert condition producing shell 1 centered on the pouring stream 2 is urged against the bottom of the distribution vessel 3 in a quasi-fluidtight manner by means of the sealing element 4 of a refractory or metalloplastic fibrous product, and/or owing to the circular collar 5.

The two semi-shells 1A and 1B are placed against each other and the seal therebetween is afforded by the baffle-shaped joint 6 throughout the length of the device.

Two gas inlets 7A and 7B, of sufficient diameter to guarantee a very low supply velocity of protective gas, open into the distributing chambers 8A and 8B. The gas then flows in a streamlined flow through the ports 9 and shrouds the metal stream down to the lower part of the shell.

In order to reduce in a significant way the dilution of the protective gas with the ambient air and thereby permit an effective protection on the major part of the length of the metal stream, aerodynamic means are used.

They mainly comprise a chamfer (or a flared shape) of the inner wall and the addition of a deflector on the outer wall of the shell 1.

The deflector moreover results in an improved covering of the upper part of the ingot mould and thus ensures a more effective production of inert conditions. Further, the dimensions and the shape of the deflector may be adapted to the different formats of the ingot moulds.

In the case of a regulation of the level by an optical sighting and/or an introduction of additional material by wire, for example, a notch may be provided in a corner of the ingot mould.

Figure 2:
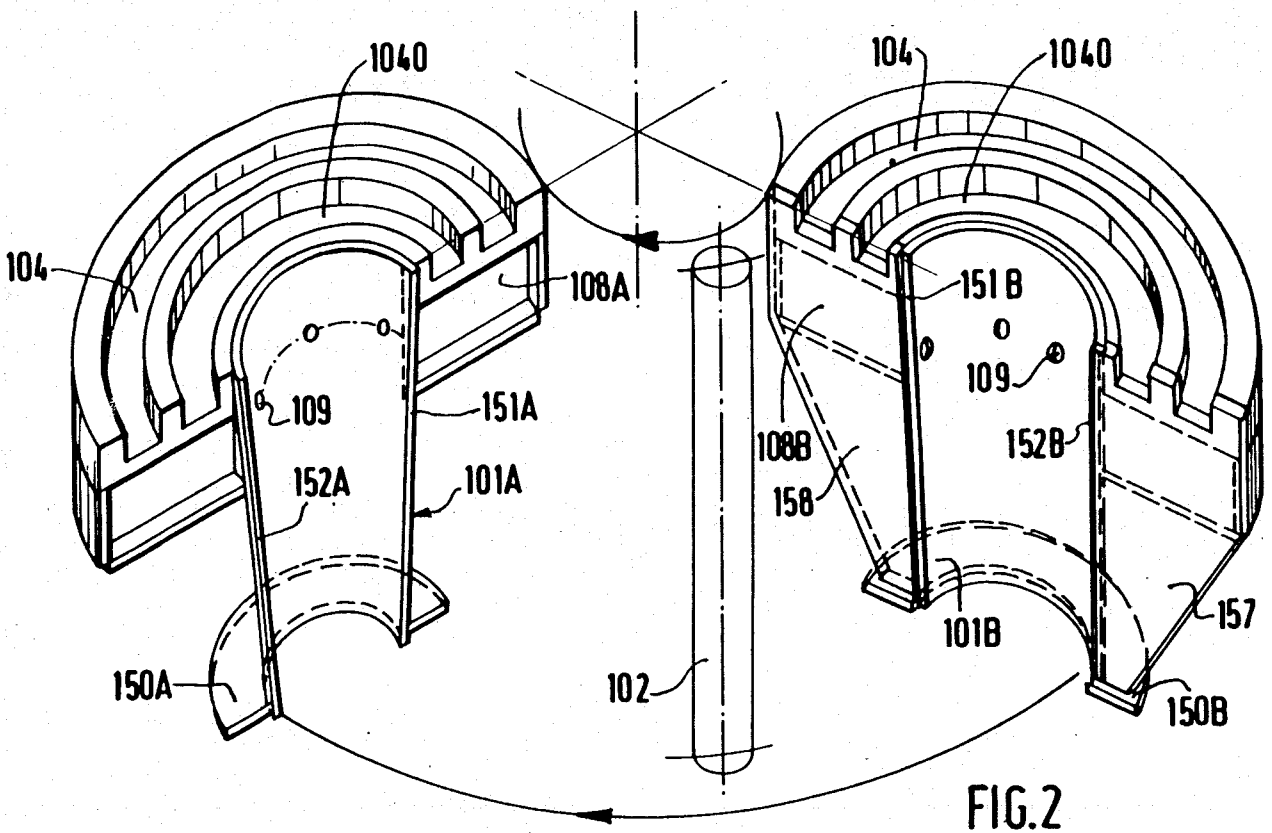
FIG. 2 is a view of an embodiment according to the invention, the two semi-shells being in their open position.

FIG. 2 is a perspective sketch showing the semi-shells in their open position around the pouring stream diagrammatically represented by the reference numeral 102.

The protecting device according to the invention comprises two complementary semi-shells 101A and 101B surrounded in their upper part by complementary distribution chambers 108A and 108B of semi-annular shape respectively connected to a gas supply (not shown in FIG. 2) and provided with ports 109 evenly spaced apart on the surface of the corresponding semi-shells 101A and 101B so as to permit the passage of the protective gas between the semi-shells 101A and 101B and the pouring stream 102. The distribution chambers 108A and 108B are closed at their ends.

Each semi-shell has in its lower part a semi-flange 150A and 150B complementary to each other. The junction between the semi-shells on the one hand and the semi-flanges on the other is achieved by means of junction planes 157 and 158 respectively extending from the base of the distribution chambers 108A and 108B to the semi-flanges 150A and 150B. These junction planes have the shape of a trapezium-rectangle if the shell is cylindrical (but this shell may also have the shape of a truncated cone). The junction planes 157 and 158 have such thickness that they straddle the joint plane of the two semi-shells and thus form a baffle as described with reference to FIG. 1. The semi-flange 150B is slightly longer than the semi-circumference of the semi-shell 101B at its base. Conversely, the semi-flange 150A is slightly shorter than the corresponding portion of the semi-shell 101A. Thus, the semi-flange 150B extends slightly beyond the junction planes 157 and 158, which enables the baffle joint to be extended at the level of the semi-flanges.

In the upper part, the distribution chamber has two annular groove 104 and 1040 for receiving elements forming a seal with the base of the distribution vessel.

FIG. 3 shows two sectional views of the device of FIG. 2 in the closed position.

Figure 3A:
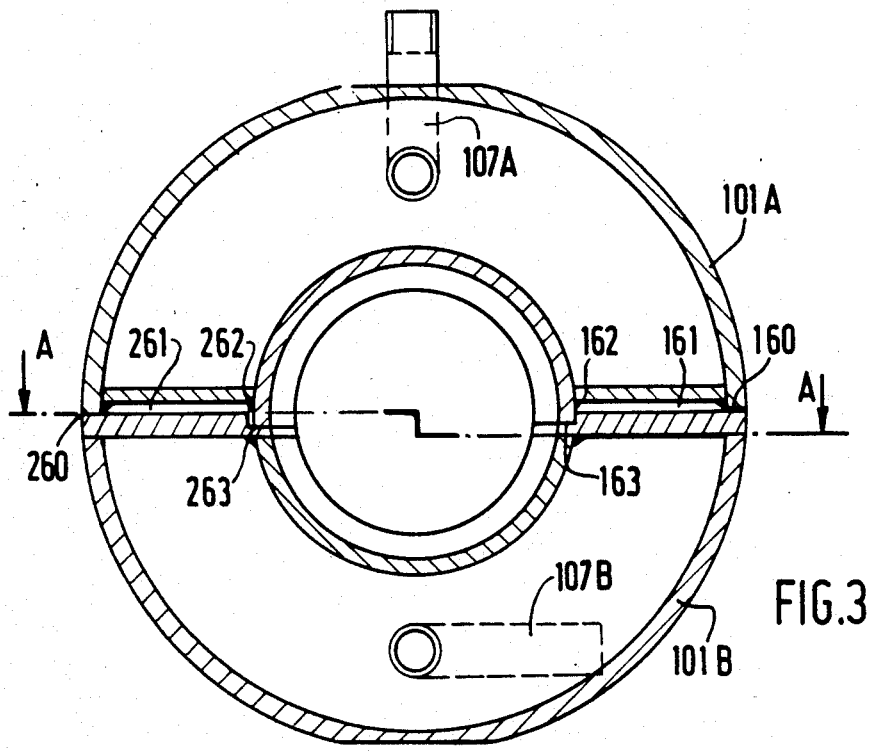
FIGS. 3A and 3B are sectional views of the embodiment of FIG. 2 with the semi-shells closed.

In FIG. 3A (which is a sectional view taken along the line B—B of FIG. 3B), elements corresponding to those of FIG. 2 carry reference numerals with the same last digits.

It will be noticed in particular that the two semi-shells 101A and 101B bear substantially one against the other at 160, 163, 260, 263 and respectively define baffles 161, 162 and 261, 262.

Figure 3B:
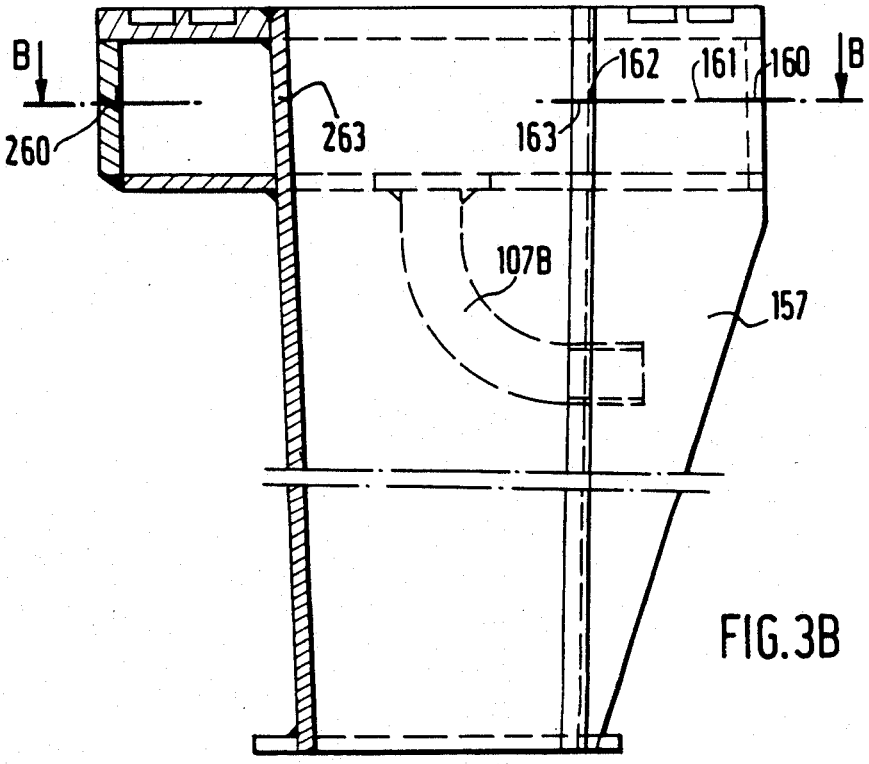

FIG. 3B, which is a sectional view taken on line A—A of FIG. 3A, has the same reference numerals as FIG. 3A.

Figure 4A:
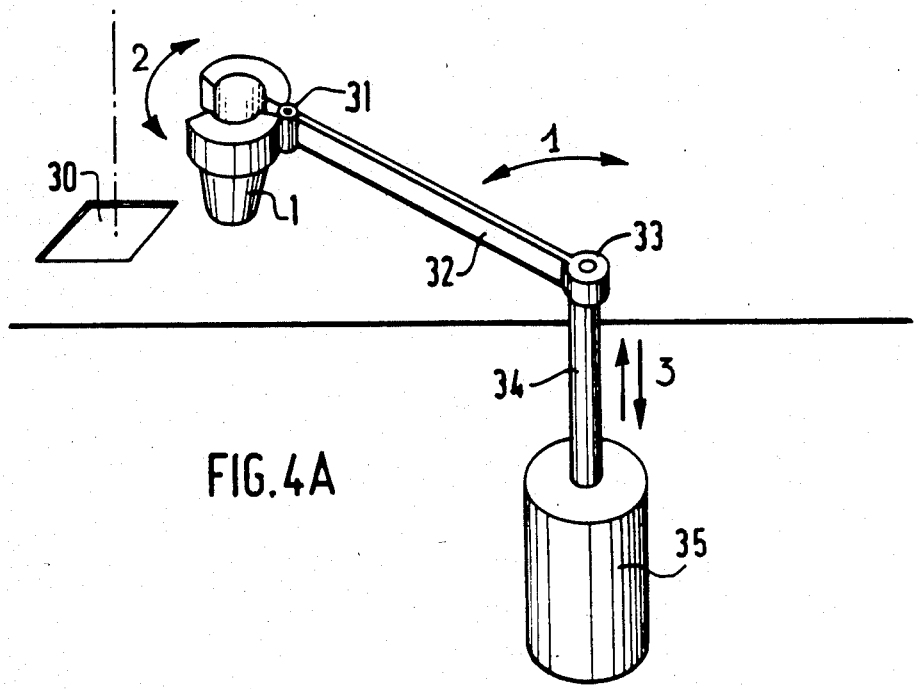
FIGS. 4A and 4B are diagrammatic views of modifications of means controlling the opening and closing of the semishells.

FIG. 4A diagrammatically represents a first modification of the assembly of the device according to the invention provided with its control means. The shell 1 comprises a hinge 31 allowing the opening and closing of the semi-shells around the pouring stream (not shown) in the opening 30 of the oscillating ingot mould. The shell 1 is connected by the hinge 31 to a first arm 32 which pivots horizontally on a second arm 34 about the articulation 33 (movement 1). The vertical arm 34 slides upwardly (movement 3) under the action of the jack 35 so that it is possible to place the device 1 flat against the distribution vessel (not shown).

Beforehand, the semi-shells would have been closed around the pouring stream (movement 2 in the FIG. ).

In this modification, the jack 35 may be fixed to the pouring table.

Figure 4B:
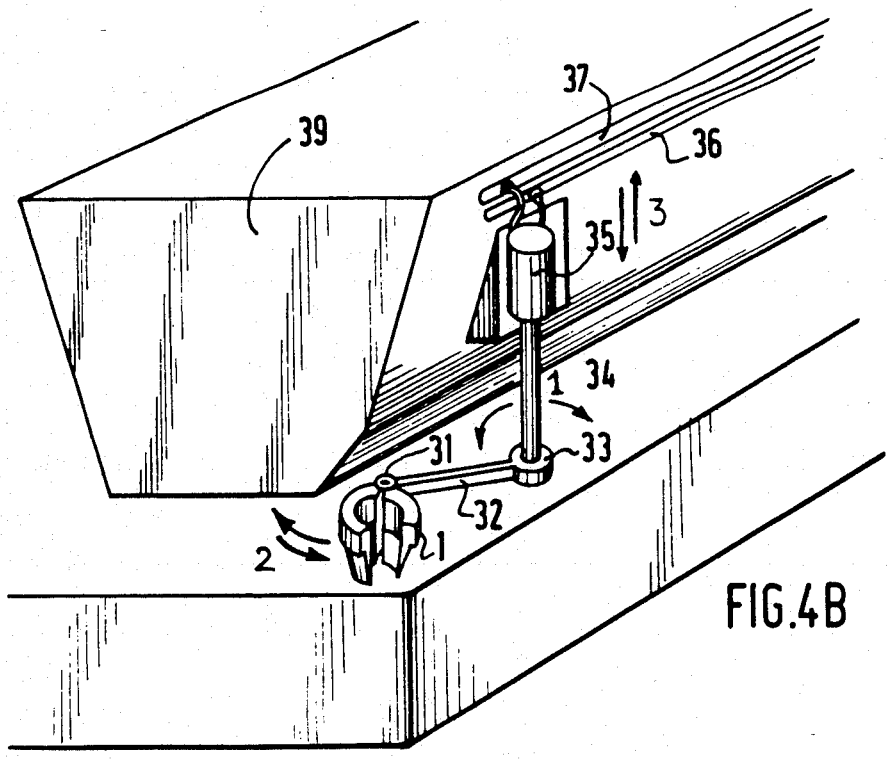

In the modification shown in FIG. 4B, the same elements carry the same reference numerals. The jack 35 is fixed to the pouring distribution vessel 39 and is supplied with compressed air (for the shifting operations) through the pipe 37 and with inert gas (argon and/or nitrogen, and/or carbon dioxide) through the pipe 36.

The protecting device is fixed to a support forming a protective gas conduit and including a movable part allowing the opening of the shells; the support may be fixed to the wall of the ladle or of the distribution vessel or on any support connected to its cradle for the purpose of being capable of shifting the device with the ladle or the distribution vessel. In some cases, this assembly may be fixed to the pouring table.

The support arm is fixed to a journal enabling the stream-protecting device to escape by a rotation thereof.

When it has been placed in position, a jack bearing on the end of the arm applies the semi-shell device against the bottom of the distribution vessel by exerting an approach force of about 50 deca Newton so as to afford the seal as soon as the jack comes into action for lowering the device. The opening articulation is automatically biased by a spring which was put under stress when closing by means of a thrust arm held in position by a device having a finger member controlled by a spring.

Figure 5:
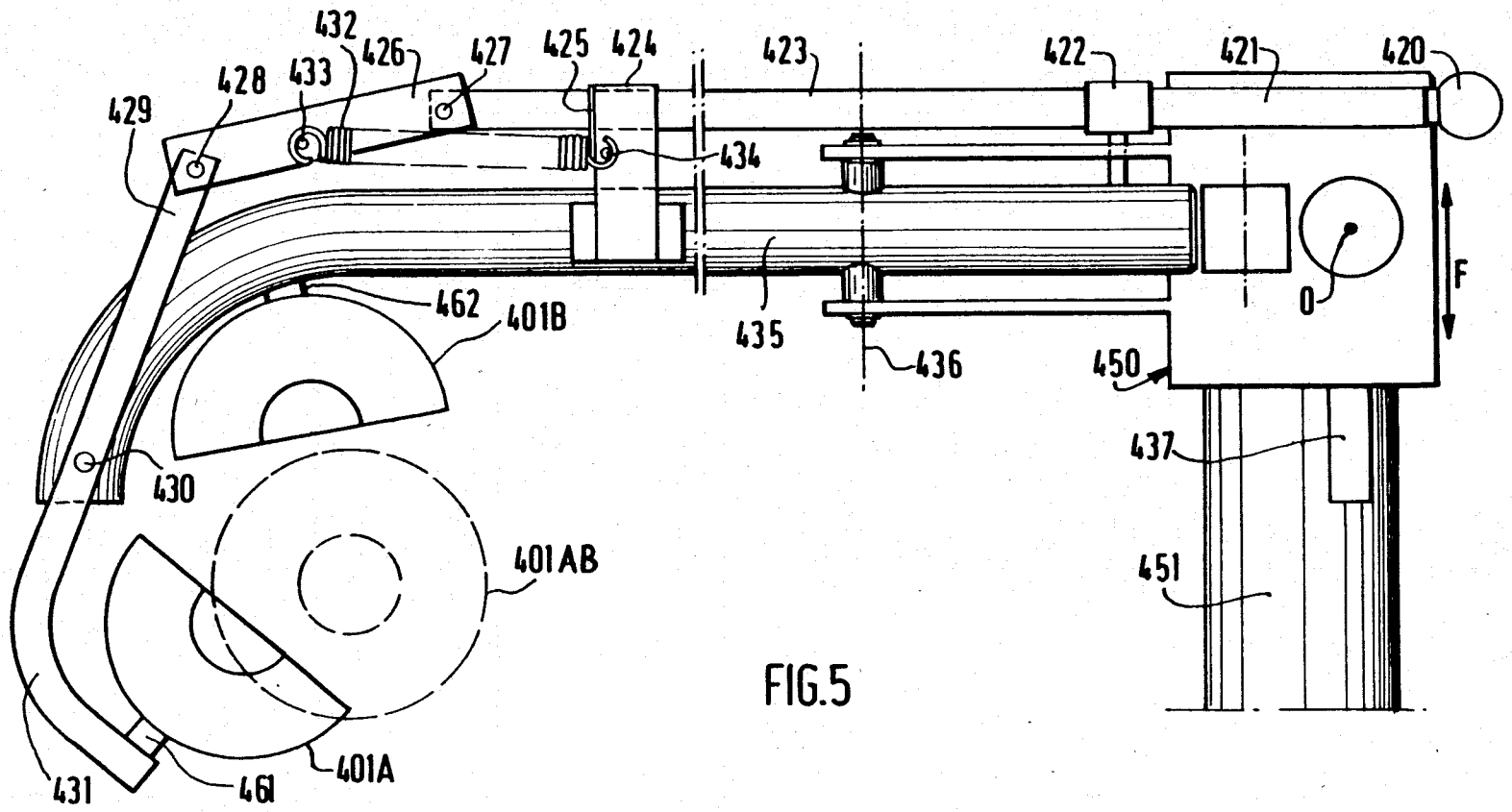
FIG. 5 is a detailed view of means controlling the movement of the semi-shells in a preferred embodiment.

FIG. 5 represents a preferred embodiment of the means for controlling the device according to the invention.

The two semi-shells are diagrammatically represented by the reference numerals 401A and 401B in the open position corresponding to the position of the control means shown in the FIG.

These control means comprise a main part constituted by a support arm 435 whose end is bent adjacent to the semi-shell 401B which is connected thereto by a ball joint 462. The latter is located substantially at the end of the straight part of the arm 435.

The other semi-shell 401A is connected, by the ball joint 461, to a plurality of articulated arms, whose end arm 431 is bent around the semi-shell 401A. The arm 431 is pivotaly connected at end 429 to the arm 426 by the articulation 428, the arm 426 is pivotally connected to the arm 423, 421 at articulation 427 and arm 423, 421 terminates in a control lever 420. The arm 423, 421 is slidable in a cylindrical guide 422 and a cylindrical guide 424. The return spring 432, fixed to the arm 426 at 433 on the one hand and to the guide 424 at 434 on the other, maintains the shells in the open position. An abutment 425 is connected to the arm 423, 421 bears against the cylindrical guide 424 so as to limit the opening travel.

The guides 422 and 424 are connected to the arm 435 which is fixed by its right end, as viewed in FIG. 5, to a carriage 450 which is slidable on a rail 451 in the direction of arrow F. A shifting handle 437 is provided for controlling the rotation of the arm 435 about the axis O perpendicular to the plane of FIG. 5. The axis 436 permits a rotation of the arm 435 so as to produce the movement of the shells in such manner as to cause them to travel through the plane of FIG. 5.

The device is placed in position in the following manner:

The semi-shells 401A and 401B are brought into vertical alignment with the pouring stream on each side of the latter by sliding the carriage 450 along the rail 451 and/or by rotation about the axis O by means of the shifting handle 437.

The control lever 420 is shifted toward the left in the direction of the guide 422 and this causes the semi-shells to close together in the position diagrammatically represented in dotted lines (a manually unlockable system locks it in this position).

The shell is then placed against the underside of the distribution vessel, for example by means of a jack which rotates the arm 435 about the axis 436. The semi-shells initially below the plane of FIG. 5 have their upper face which passes above the plane of this FIG. The reference 401AB represents the two closed semi-shells brought to this position after rotation of the arm 435 about the axis O (perpendicular to the plane of FIG. 5) followed by a closure of the semi-shells by means of the control lever 420 (then rotation of the arm 435 about the axis 436).

EXAMPLE 1

In the case of the casting of steel containing Si-Mn, the billets of which have a square section with a side dimension of 105 mm, there is used a protecting shell (or tube) having an inside diameter of 80 mm and a base without a flange. The rate of flow of nitrogen is 60 $Nm^3$/metric ton. The lower part of the shell is placed at a mean distance from the oscillating ingot mould equal to 50 mm. The velocity of ejection of the protective gas of the shell in the region of the periphery of its lower part is about 1.5 m/s, and about 3.5 m/s close to the liquid metal stream.

With these conditions of operation and without the use of a fan, which is unnecessary in this case of good inert conditions, the following contents of oxygen are measured:

inside the shell $<0.5\%$
at the outlet of the shell $<0.6\%$
in the ingot mould $<0.9\%$ These values give good metallurgical results.

EXAMPLE 2

Operating under the same conditions as before with a flow rate of 30 $Nm^3$/h, the velocity of exit of the gas at the periphery of the lower part of the shell is about 0.7 m/s and 3 m/s in the vicinity of the pouring stream. Results a little inferior to the preceding results are obtained (the curve of concentration of oxygen equal to 1% between the lower part of the shell and the opening of the ingot mould is slightly closer to the pouring stream than before, but the latter remains perfectly protected).

However, the measured contents of oxygen in the ingot mould are generally greater than 1%. With flow rates of protective gas of about 30 $Nm^3$/h and lower, the oscillations of the ingot mould generate a dilution of said gas in such a way that it is generally not possible to obtain an oxygen content lower than 1% in the ingot mould in the vicinity of the metal stream.

EXAMPLE 3

Operating under the same conditions as before with a flow rate of 90 $Nm^3$/h, the velocity of exit of the gases is respectively 2.5 m/s and 5.5 m/s.

The results are substantially identical to those obtained in Example 1 as concerns the concentration of oxygen.

EXAMPLES 4, 5 AND 6

The examples 1, 2 and 3 are repeated with the addition of a flange of 6 mm chamfered at about 45° around the lower part of the shell parallel to the opening of the ingot mould.

The curves of concentration at a constant level of oxygen around the pouring stream are substantially further away from the stream than the corresponding curves without a flange, which denotes a slight improvement in the results. The use of a flange may therefore be found advantageous when it is desired to decrease still more the concentrations of oxygen in the vicinity of the pouring stream.

EXAMPLES 7, 8 AND 9

The examples 1, 2 and 3 are repeated by forming a flare at the bottom of the shell, which widened the internal diameter of said shell from about 80 to about 92 mm.

It is generally preferred to choose a flare having a circular section, whose height is about equal to the increase of the radius of the shell. In the present case, this height is about 6 mm.

Surprisingly, oxygen contents are the same than those of the corresponding examples 1, 2 and 3 but with a reduced flow rate of protective gas.

What is claimed is:

1. A process for protecting against oxidation and/or nitridation of a liquid metal pouring stream flowing from an outlet orifice of a ladle or a distribution vessel into an oscillating ingot mould, comprising surrounding the pouring stream in at least a part of the height of the pouring stream with a tube having a lower part and an outlet orifice in said lower part, injecting into the tube a gas for protecting the liquid metal stream and thereby limiting contact of the liquid metal with the ambient air between the outlet orifice of the tube and the oscillating ingot mould, the protective tube being sealably connected to the ladle or the distribution vessel, the protective tube having such length that the maximum distance $D_1$ between the lower part of the tube and the oscillating ingot mould, when the ingot mould is in a lower position, is less then 100 mm, and the protective tube having impervious means for effecting an aerodynamic deflection placed in the vicinity of the lower part of the tube and surrounding the tube substantially throughout the periphery thereof, the process further comprising injecting the protective gas into the tube at a flow rate in excess of 30 $Nm^3$/hour to surround the pouring stream, and discharging the protective gas to the exterior through the lower part of said tube with a mean velocity of the gases discharged in the vicinity of the lower part of the tube of between about 0.7 m/s and 5.5 m/s so as to limit the dilution of the protective gas with the air at any point in the vicinity of the pouring stream and the aspiration of the ambient air toward the pouring stream.

2. A process according to claim 1, wherein the distance $D_1$ is less than or equal to 80 mm.

3. A process according to claim 1, wherein the diameter $D_2$ of the tube in the lower part thereof is no more than the width of the oscillating ingot mould.

4. A process according to claim 1, wherein the means for effecting an aerodynamic deflection comprises a flare at the lower part of the tube and surrounding the tube substantially throughout the periphery thereof.

5. A process according to claim 1, in which the gas is injected into said tube along a streamlined gradually curving path.

6. A process according to claim 1, wherein the means for effecting an aerodynamic deflection comprises a flange placed in the vicinity of the lower part of the tube and surrounding the tube substantially throughout the periphery thereof.

7. A process according to claim 6, wherein the tube has such diameter that the diameter $D_3$ of the flange is less than or equal to the width of the oscillating ingot mould.

8. A process according to claim 1, wherein the flange is substantially parallel to a plane of the ingot mould.

9. A device for protecting against oxidation and/or nitridation of a liquid metal pouring stream flowing from an outlet orifice of a ladle or a distribution vessel, said device comprising means for surrounding the pouring stream in at least a part of the height of the pouring stream, means for injecting a protective gas into said means for surrounding the pouring stream at a flow rate in excess of 30 $Nm^3$/hour, said protective gas surrounding the pouring stream so as to minimize contact of the liquid metal with the ambient air, the means for surrounding the pouring stream comprising two complementary semi-shells, means for articulating the semi-shells so as to permit an opening and closing thereof, impervious aerodynamic deflecting means located close to a lower part of the semi-shells, and at least one annular sealing element in an upper part of the device for providing a seal between the shell and the distribution vessel.

10. A device according to claim 9, wherein the aerodynamic deflecting means comprise a flange constituted by two semi-flanges each connected to a respective semi-shell.

11. A device according to claim 9, wherein each semi-shell comprises an inner wall having a lower end and an outer wall having a lower end, and the deflecting means comprises a chamfered portion located at said lower end of said inner wall of each semi-shell and extending toward said outer wall of each semi-shell.

12. A device according to claim 9, comprising a concentric sleeve placed around the semi-shells and formed by two complementary semi-sleeves each connected to a respective semi-shell, the sleeve and the semi-shells defining a space, and means for injecting a protective gas to said space.

13. A device according to claim 9, wherein the two semi-shells have junction planes which partly overlap so as to improve fluidtightness of the shell.

14. A device according to claim 9, for coupling to the distribution vessel around the pouring orifice of the distribution vessel, the distribution vessel including a circular collar cooperative with the device and adapted to improve gastightness of the coupling.

15. A device according to claim 9, wherein the means for articulating the semi-shells comprise an assembly of articulated arms for moving the semi-shells away from each other, and control means for controlling the articulated arms.

16. A device according to claim 9, comprising means for placing the shell flat against the distribution vessel, and a movable arm which is connected to the device at an end and connected to said means for placing the shell flat against the distribution vessel.

17. A device according to claim 9, wherein the means for surrounding the pouring stream have such length that they surround the pouring stream substantially throughout the height of the pouring stream.

18. A device for protecting against oxidation and or nitridation of a liquid metal pouring stream flowing from an outlet orifice of a distribution vessel, said device comprising a protective shell surrounding the pouring stream in at least a part of the height of the pouring stream, said protective shell including two complementary semi-shells relatively movable with respect to each other between an open position and a closed position, articulating means including a plurality of pivotally connected arms for opening and closing the protective shell, one of said arms being connected to one of the semi-shells and another of said arms being reciprocably movable to pivot said one arm and thereby open and close said protective shell, conduit means for injecting protective gas into the protective shell and around the pouring stream so as to minimize contact of the liquid metal with the ambient air, impervious aerodynamic deflecting means adjacent the lower part of the protective shell, and at least on annular sealing element adjacent the upper part of the protective shell for providing a seal between said protective shell and the distribution vessel.

19. A device for protecting against oxidation and/or nitridation of a liquid metal pouring stream flowing from an outlet orifice of a distribution vessel, said device comprising a protective shell surrounding the pouring stream in at least a part of the height of the pouring stream, said protective shell including two complementary semi-shells relatively movable with respect to each other between an open position and a closed position, articulating means for opening and closing the protective shell, means for injecting protective gas into the protective shell and around the pouring stream so as to minimize contact of the liquid metal with the ambient air, aerodynamic deflecting means including an outwardly curved impervious lip adjacent the lower part of the protective shell, and at least one annular sealing element adjacent the upper part of the protective shell for providing a seal between said protective shell and the distribution vessel.

* * * * *